US011101542B2

(12) United States Patent
Tang

(10) Patent No.: US 11,101,542 B2
(45) Date of Patent: Aug. 24, 2021

(54) INTEGRATED RADIO PACKAGE HAVING A BUILT-IN MULTI DIRECTIONAL ANTENNA ARRAY

(71) Applicant: NXP USA, Inc., Austin, TX (US)

(72) Inventor: Jinbang Tang, Chandler, AZ (US)

(73) Assignee: NXP USA, INC., Austin, TX (US)

( * ) Notice: Subject to any disclaimer, the term of this patent is extended or adjusted under 35 U.S.C. 154(b) by 14 days.

(21) Appl. No.: 16/695,589

(22) Filed: Nov. 26, 2019

(65) Prior Publication Data

US 2021/0159584 A1 May 27, 2021

(51) Int. Cl.

| | |
|---|---|
| ***H01Q 21/00*** | (2006.01) |
| ***H01Q 1/22*** | (2006.01) |
| ***H01Q 9/04*** | (2006.01) |
| *H01Q 1/24* | (2006.01) |

(52) U.S. Cl.

CPC ..... *H01Q 1/2283* (2013.01); *H01Q 9/0435* (2013.01); *H01Q 21/0025* (2013.01); *H01Q 21/0087* (2013.01); *H01Q 1/2291* (2013.01); *H01Q 1/241* (2013.01)

(58) Field of Classification Search

CPC ..... H01Q 9/0407; H01Q 1/38; H01Q 1/42; H01Q 21/065; H01Q 1/2283; H01Q 1/243; H01Q 23/00; H01Q 21/205; H01Q 7/00; H01Q 9/0435; H01Q 21/0025; H01Q 21/0087; H01Q 1/2291; H01Q 1/241; H01C 9/0407; H01C 1/2283; H01C 7/00; H01C 1/2291

USPC ..... 343/776, 780, 786, 799, 879

See application file for complete search history.

(56) References Cited

U.S. PATENT DOCUMENTS

| | | | | |
|---|---|---|---|---|
| 7,164,903 | B1 | 1/2007 | Cliff et al. | |
| 7,460,083 | B2 * | 12/2008 | Parsche | H01Q 9/27 343/799 |
| 7,675,466 | B2 | 3/2010 | Gaucher et al. | |
| 7,768,457 | B2 | 8/2010 | Pettus et al. | |
| 7,982,680 | B1 * | 7/2011 | Lopez | H01Q 9/36 343/780 |
| 8,407,890 | B2 | 4/2013 | Tang | |
| 9,172,143 | B2 | 10/2015 | Tang | |
| 10,121,751 | B2 | 11/2018 | Lachner et al. | |
| 10,193,236 | B1 * | 1/2019 | Lee | H01Q 3/24 |
| 2004/0108966 | A1 * | 6/2004 | McKivergan | H01Q 1/362 343/895 |
| 2008/0036674 | A1 * | 2/2008 | Riedel | H01Q 21/26 343/818 |
| 2008/0074339 | A1 * | 3/2008 | Lee | H01Q 21/24 343/803 |

(Continued)

OTHER PUBLICATIONS

U.S. Appl. No. 16/450,064, filed Jun. 24, 2019 with the U.S. Patent and Trademark Office.

*Primary Examiner* — Linh V Nguyen

(57) ABSTRACT

A semiconductor device package having at least one integrated circuit (IC) die, at least two antennas oriented in at least two different directions, and a combiner/divider structure connecting the at least two antennas to the at least one IC die and configured to combine/divide signals transmitted between the at least two antennas and the at least one IC die. The package may be fabricated using an additive manufacturing process (i.e., 3D printing). In certain embodiments, the package is an integrated radio package having a multi-directional antenna array.

17 Claims, 7 Drawing Sheets

(56) References Cited

U.S. PATENT DOCUMENTS

| | | | | |
|---|---|---|---|---|
| 2010/0007572 | A1* | 1/2010 | Jones | H01Q 21/24 343/798 |
| 2011/0279339 | A1* | 11/2011 | Johnston | H01Q 19/10 343/786 |
| 2012/0062437 | A1* | 3/2012 | Hung | H01Q 5/357 343/799 |
| 2013/0187821 | A1* | 7/2013 | Lecam | H01Q 1/246 343/799 |
| 2013/0278476 | A1* | 10/2013 | Peng | H01Q 1/246 343/776 |
| 2017/0346191 | A1* | 11/2017 | Farzaneh | H01Q 19/028 |
| 2018/0076864 | A1* | 3/2018 | Jan | H01Q 1/42 |

* cited by examiner

INTEGRATED RADIO PACKAGE HAVING A BUILT-IN MULTI DIRECTIONAL ANTENNA ARRAY

CROSS-REFERENCE TO RELATED APPLICATIONS

The subject matter of this application is related to U.S. patent application Ser. No. 16/450,064, filed Jun. 24, 2019, the teachings of which are incorporated herein by reference in their entirety.

BACKGROUND

Field

This disclosure relates generally to semiconductor device packaging, and more specifically, to integrated radio packages having built-in antennas.

Related Art

As the size of electronic components becomes smaller and smaller, and as the size of devices containing those electronic components also decreases, density demands for electronic chip packaging become greater and greater. Three-dimensional packaging has emerged as a solution for achieving the higher densities of components necessitated by these small devices.

For small electronic devices incorporating radio functions (e.g., WiFi, 5G, Bluetooth, and the like), there are advantages to providing antennas for the radios in the electronic component packages themselves. This is especially true for high-frequency radios, where connection distance between a device die that provides the radio functionality and the antenna is important.

BRIEF DESCRIPTION OF THE DRAWINGS

Embodiments of the present invention may be better understood by referencing the accompanying drawings.

Note that FIGS. 1 and 4-6 are simplified views that do not show all of the structures of those devices, such as horizontal routing and ground planes and vertical through holes and via structures. The use of the same reference symbols in different drawings indicates identical items unless otherwise noted. The figures are not necessarily drawn to scale.

DETAILED DESCRIPTION

Traditional integrated radio packages having built-in antennas have one or more antennas, all of which are oriented in the same direction. In order to form a multi-directional antenna array, multiple instances of such traditional integrated radio packages having unidirectional antennas or unidirectional antenna arrays must be deployed and configured in different directions in order to span the multiple directions of the multi-directional antenna array. Embodiments of the present disclosure, on the other hand, provide an integrated radio package having a built-in multi-directional antenna array, which can reduce both cost and complexity of deployment. For example, because an integrated radio package of the present disclosure has a built-in multi-directional antenna array, the prior-art cost of providing multiple devices is reduced and the prior-art complexity of having to align multiple unidirectional packages in different directions is avoided.

Figure 1:
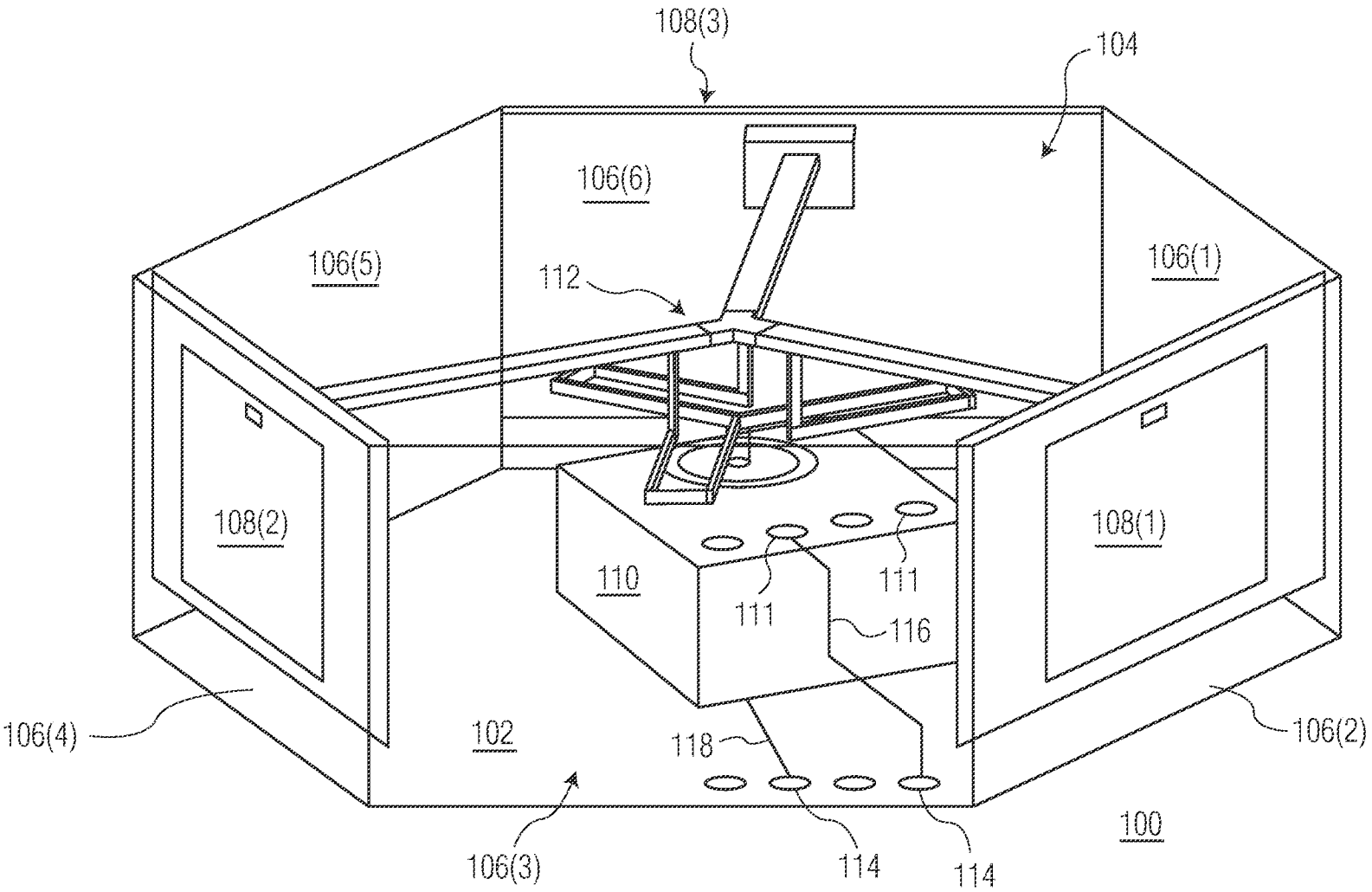
FIG. 1 is a perspective, cut-away view of an integrated radio package having a built-in three-directional antenna array according to one embodiment of the present disclosure.

FIG. 1 is a perspective, cut-away view of an integrated radio package 100 having a built-in three-directional antenna array according to one embodiment of the present disclosure. In particular, the radio package 100 has the shape of a regular hexagonal prism, with a hexagonal bottom 102, a hexagonal top 104, and six rectangular sides 106(1)-106(6) that are oriented normal to the bottom 102 and the top 104, where the three sides 106(2), 106(4), and 106(6) have three respective planar patch antennas 108(1), 108(2), and 108(3) oriented with their normal directions 120 degrees apart from one another. Located on the bottom 102 of the radio package 100 is an integrated circuit (IC) die 110 that provides the radio functions of the radio package 100 and is electrically connected to the three antennas 108(1)-108(3) by an integrated, three-dimensional (3D), three-way Wilkinson power combiner/divider structure 112.

Although not shown in FIG. 1, the volume of the radio package 100 is filled with an insulating potting compound (such as a dielectric polyimide or other suitable polymer). that encapsulates the other elements of the radio package 100 and forms the outer surface of the radio package 100, except for the three antennas 108(1)-108(3) and signal pads 114 on the bottom of the IC die 110 that provide external electrical access to the radio package 100. As represented in FIG. 1, the IC die 110 may have top-side die pads 111 that can be connected to the signal pads 114 via traces 116 and/or bottom-side die pads (not shown) that can be connected to the signal pads via traces 118. Although also not shown in FIG. 1, the radio package 100 may have additional elements, such as one or more other IC dies providing other radio and/or non-radio functions in the radio package 100. Furthermore, the radio package 100 will also have routing and ground planes that are not shown in FIG. 1.

When the radio package 100 is configured to function as a radio transmitter, the Wilkinson structure 112 functions as a three-way power divider that divides an outgoing RF signal received from the die 110 into three outgoing divided RF signals having substantially equal power to be radiated by the three respective antennas 108(1)-108(3). Analogously, when the radio package 100 is configured to function as a radio receiver, the Wilkinson structure 112 functions as a three-way power combiner that combines three incoming RF signals received from the three respective antennas 108(1)-108(3) into a single incoming combined RF signal that is input to the die 110 for further radio processing. Note that, in some implementations, the radio package 100 may be configured to operate concurrently as a radio transmitter and as a radio receiver.

Figure 2:
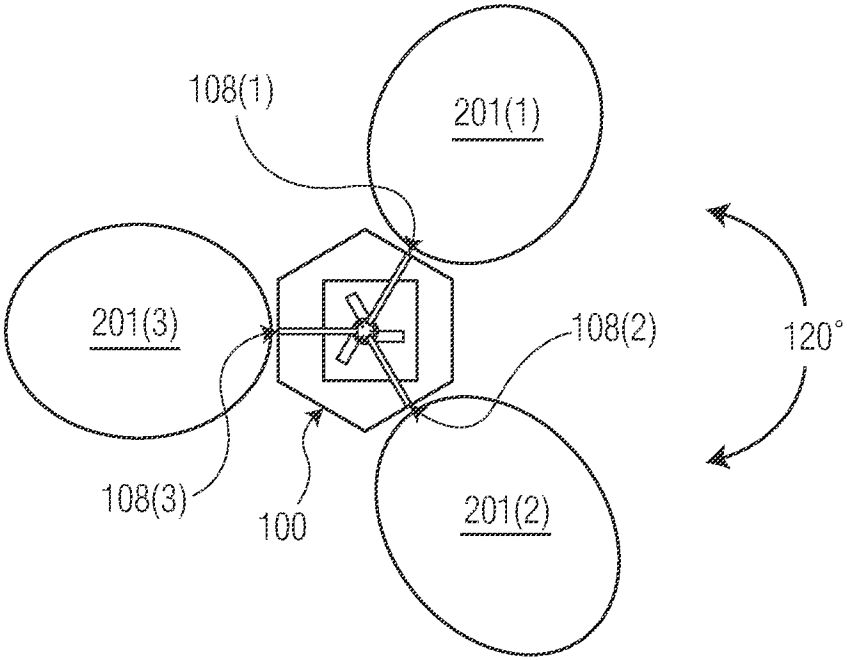
FIG. 2 is a plan view illustrating the three lobes of the three-directional antenna pattern formed by the three antennas of the three-directional antenna array of the radio package of FIG. 1.

FIG. 2 is a plan view illustrating the three lobes 201(1)-201(3) of the three-directional antenna pattern formed by the three antennas 108(1)-108(3) of the three-directional antenna array of the radio package 100 of FIG. 1 and separated from each other by 120 degrees.

Figure 3:
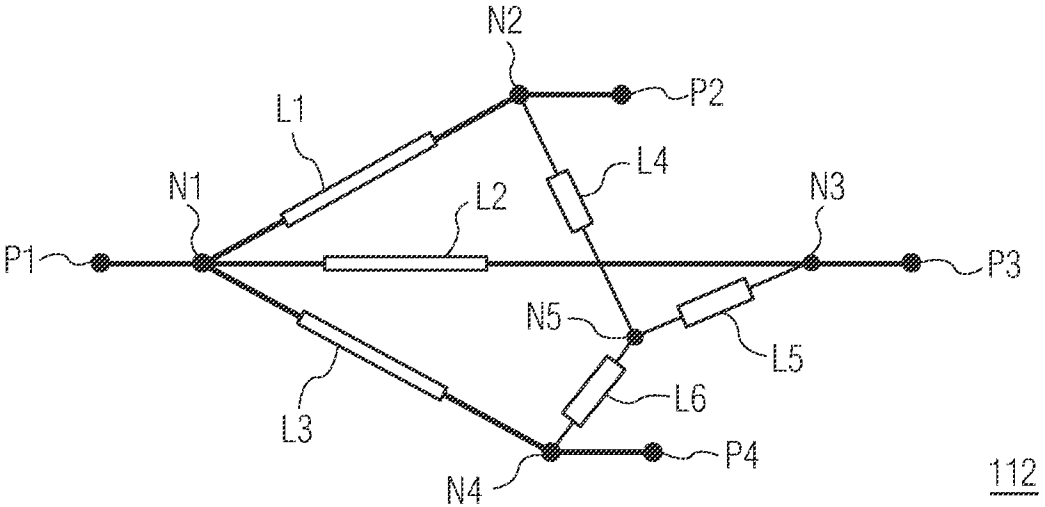
FIG. 3 is a schematic circuit diagram of one practical implementation of the three-way Wilkinson power combiner/divider structure of the radio package of FIG. 1.

FIG. 3 is a schematic circuit diagram of one practical implementation of the three-way Wilkinson power combiner/divider structure 112 of the radio package 100 of FIG. 1 having a "star-resistor" configuration. As shown in FIG. 3, the Wilkinson structure 112 is a four-port device, where port P1 correspond to the connection to the die 110 of FIG. 1 and ports P2-P4 correspond to the respective connections to the three antennas 108(1)-108(3) of FIG. 1. In addition, the Wilkinson structure 112 has six links (L1-L6) interconnected at five nodes (N1-N5), where:

Link L1 connects node N1 at port P1 and node N2 at port P2;

Link L2 connects node N1 at port P1 and node N3 at port P3;

Link L3 connects node N1 at port P1 and node N4 at port P4;

Link L4 connects node N2 at port P2 and node N5;

Link L5 connects node N3 at port P3 and node N5; and

Link L6 connects node N4 at port P4 and node N5.

As understood by those skilled in the art, the three links L4-L6 each have impedance $Z_0$, while the three links L1-L3 each have impedance SQRT(3) $Z_0$, where links L1-L3 are all one-quarter wavelength transmission lines. With those relative impedance values, the circuitry will provide the Wilkinson structure 112 with the desired dividing/combining functionality.

Those skilled in the art also understand that a three-way Wilkinson structure cannot be practicably implemented in a simple planar topology (although planar topologies are possible). For example, in the implementation of FIG. 3 in which node N5 lies "between" links L2 and L3, links L2 and L4 are skewed links (i.e., non-intersecting links that "cross" one another at different levels in the structure). In another practical implementation in which node N5 lies between links L1 and L2 instead of lying between links L2 and L3, links L2 and L6 will be skewed links. In general, every practicable implementation of a three-way Wilkinson structure will have at least two skewed links. As such, a practicable implementation of the three-way Wilkinson structure 112 of FIG. 1 is a three-dimensional structure.

Figure 4:
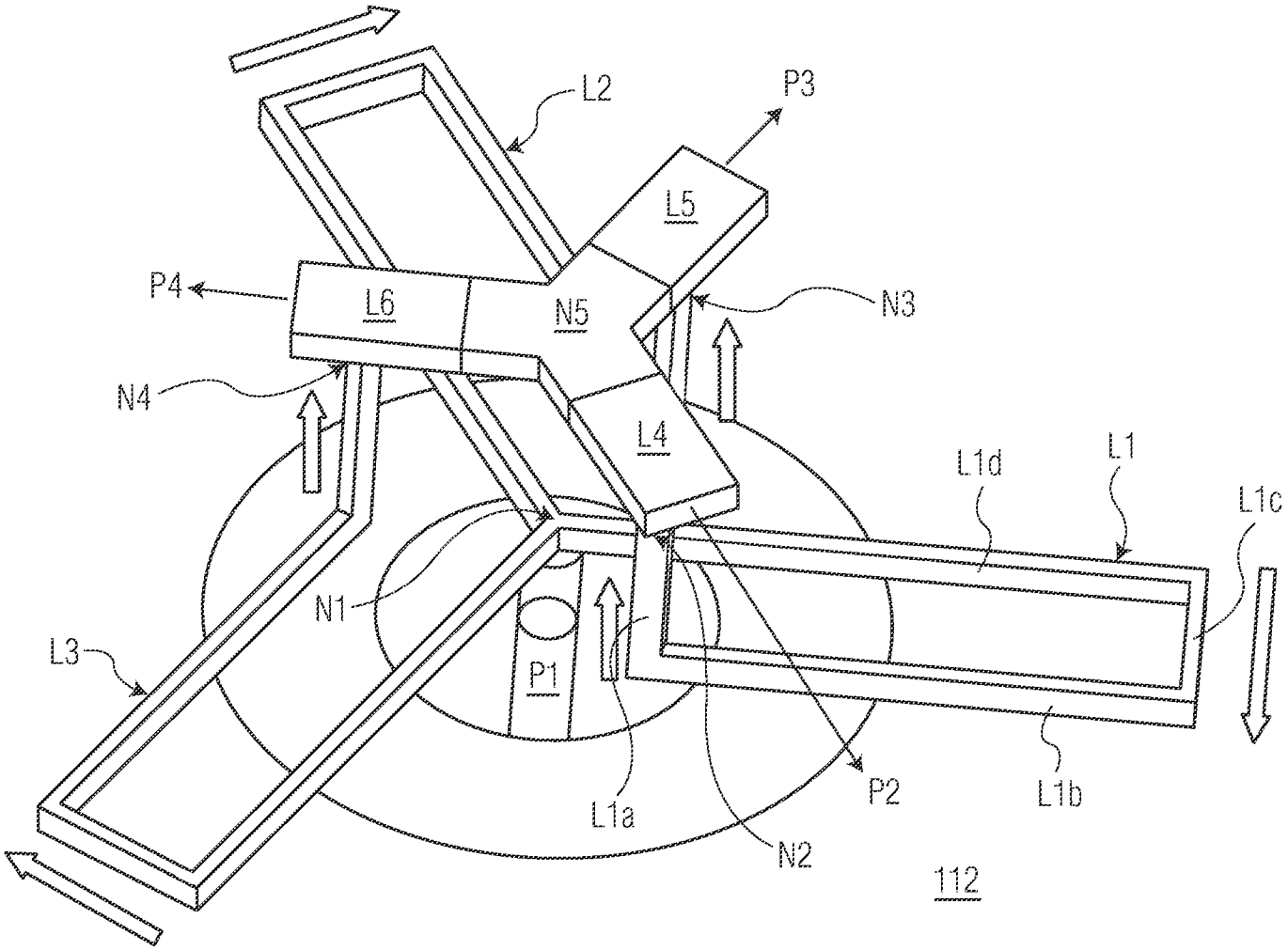
FIG. 4 is a perspective view of one possible 3D implementation of the three-way Wilkinson power combiner/divider structure of the radio package of FIG. 1.

FIG. 4 is a perspective view of one possible 3D implementation of the three-way Wilkinson power combiner/divider structure 112 of the radio package 100 of FIG. 1 having ports P1-P4, links L1-L6, and nodes N1-N5 corresponding to the circuit diagram of FIG. 3. Note that only the proximal portion of each of links L4-L6 is shown in FIG. 4. As shown in FIG. 4, links L1-L3 each follow a horizontal rectilinear path, while links L4-L6 each have a horizontal planar shape. Using rectilinear shapes for the links L1-L6 enables the links to be fabricated using 3D printing, where the structure 112 is built from the bottom up with lower horizontal links formed before higher horizontal links, while meeting electrical and physical requirements. As understood by those skilled in the art, by extruding dielectric and conductive material inks directly from a printer, 3D printing can be used to package IC dies into fully operational packaged modules by printing the remaining insulating and conducting elements of the modules. For example, link L1 comprises vertical sub-link Da connected at one end to link L4 at node N2, horizontal sub-link L1*b* connected at a right angle to the other end of sub-link L1*a*, horizontal sub-link L1*c* connected at a right angle to sub-link L1*b*, and horizontal sub-link L1*d* connected at a right angle to sub-link L1*c* and to port P1 at node N1, where the sub-links L1*b*-L1*d* follow a horizontal rectilinear path. Link L1 is said to follow a rectilinear path because its (straight) sub-links are interconnected at right angles. Furthermore, a (straight) sub-link is said to have a rectilinear shape because its lateral cross section has a rectangular shape (e.g., a square). The arrows in FIG. 4 represent the direction of signal flow from port P1 to ports P2-P4.

Figure 5:
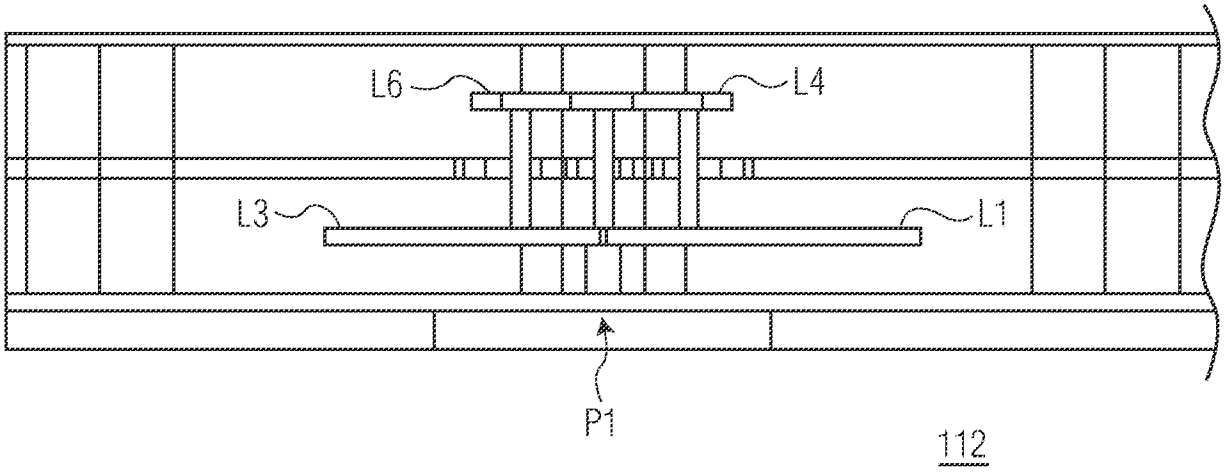
FIG. 5 is a side view of the 3D, three-way Wilkinson power combiner/divider structure of FIG. 4.

FIG. 5 is a side view of the 3D, three-way Wilkinson power combiner/divider structure 112 of FIG. 4 showing the elevation level of the horizontal links L4-L6 above the elevation level of the horizontal sub-links of links L1-L3. Note that the vertical via structures forming the vertical sub-links of links L1-L3 (e.g., sub-link L1*a* of FIG. 4) and the ground planes are not shown in FIG. 5.

Figure 6:
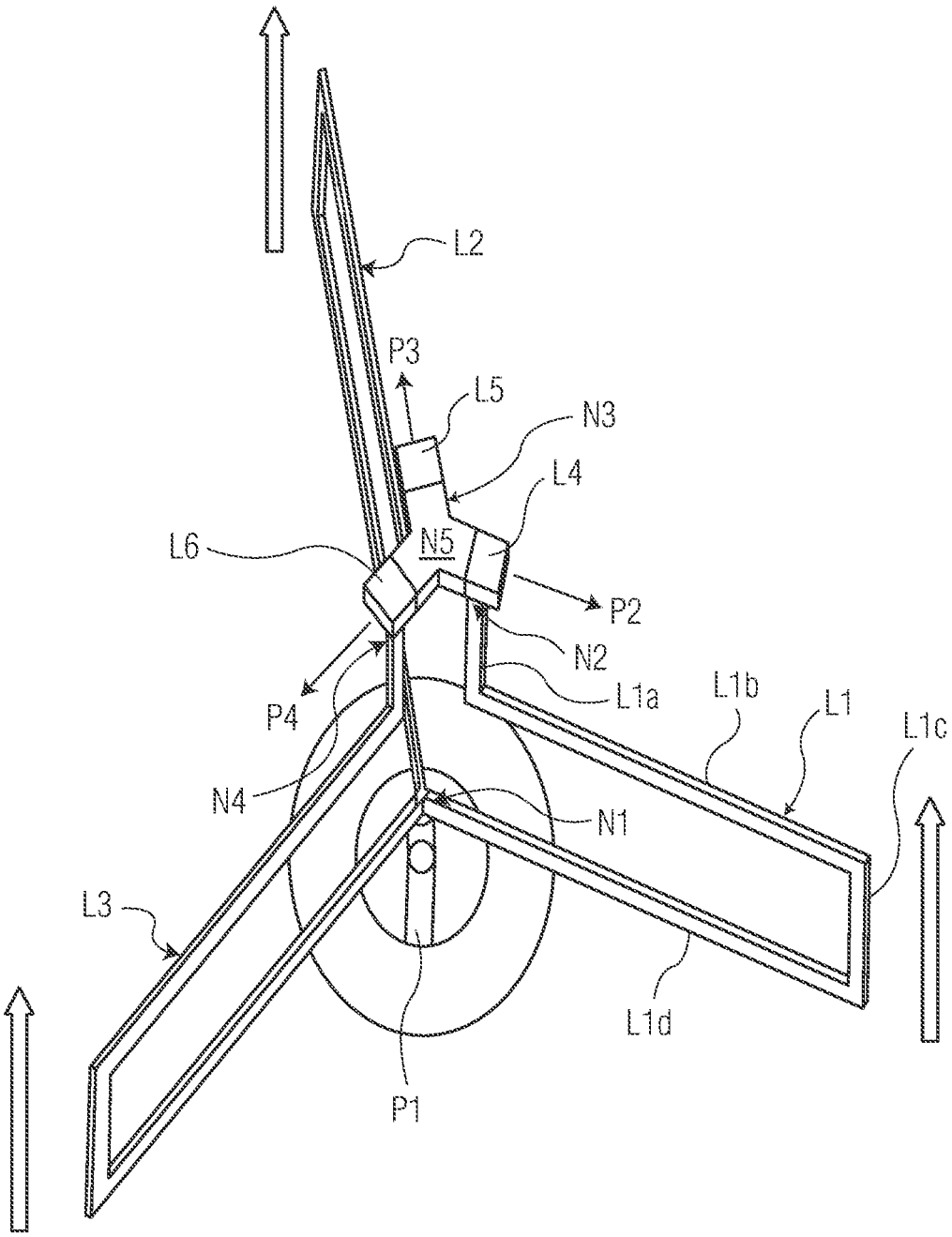
FIG. 6 is a perspective view of another possible 3D implementation of the three-way Wilkinson power combiner/divider structure of the radio package of FIG. 1.

FIG. 6 is a perspective view of another possible 3D implementation of the three-way Wilkinson power combiner/divider structure 112 of the radio package 100 of FIG. 1 having ports P1-P4, links L1-L6, and nodes N1-N5 corresponding to the circuit diagram of FIG. 3. Note that only the proximal portion of each of links L4-L6 is shown in FIG. 6. As shown in FIG. 6, links L1-L3 each follow a vertical rectilinear path, while links L4-L6 each have a horizontal planar shape. For example, link L1 comprises vertical sub-link L1*a* connected at one end to link L4 at node N2, horizontal sub-link L1*b* connected at a right angle to the other end of sub-link L1*a*, vertical sub-link L1*c* connected at a right angle to sub-link L1*b*, and horizontal sub-link L1*d* connected at a right angle to sub-link L1*c* and to port P1 at node N1, where the sub-links L1*b*-L1*d* follow a vertical rectilinear path. The arrows in FIG. 6 represent the direction of signal flow from port P1 to ports P2-P4.

Although the radio package 100 of FIG. 1 has a three-directional antenna array in which an antenna 108 is located on every other one of the six sides 106, in general, a radio package of the present disclosure has a multi-directional antenna array having two or more antennas located on two or more different sides of the radio package.

Figure 7:
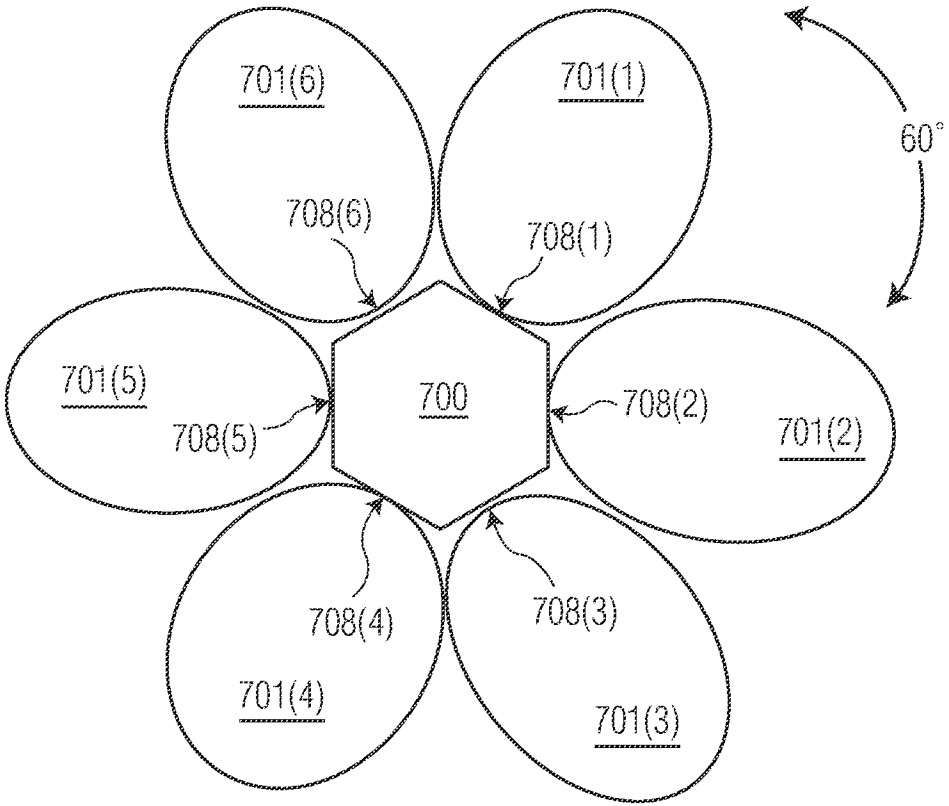
FIG. 7 is a plan view illustrating the six lobes of the six-directional antenna pattern formed by the six antennas of the six-directional antenna array of a radio package according to an alternative embodiment of the present disclosure.

For example, FIG. 7 is a plan view illustrating the six lobes 701(1)-701(6) of the six-directional antenna pattern formed by the six antennas 708(1)-708(6) of the six-directional antenna array of a radio package 700 and separated from each other by 60 degrees, according to an alternative embodiment of the present disclosure. Those skilled in the art will understand that the combiner/divider structure for such a six-directional radio package 700 may be implemented with (i) two three-way structures connected to one two-way structure or (ii) three two-way structures connected to one three-way structure. For example, in the former implementation, a first three-way structure could be connected to antennas 708(1), 708(3), and 708(5), a second three-way structure could be connected to antennas 708(2), 708(4), and 708(6), and the one two-way structure could be connected between the two three-way structures and the port P1. As an example of the latter implementation, a first two-way structure could be connected to antennas 708(1) and 708(2), a second two-way structure could be connected to antennas 708(3) and 708(4), a third two-way structure could be connected to antennas 708(5) and 708(6), and the one three-way structure could be connected between the three two-way structures and the port P1.

In certain implementations, an antenna could be located on the top 104 and/or an antenna could be located on the bottom 102 of a radio package having the regular hexagonal prism shape of the radio package 100 of FIG. 1.

Although the radio packages of the present disclosure have been described as having only one antenna on a side, in other embodiments, a multi-directional radio package may have two or more sides with antennas, where at least one of those sides has more than one antenna.

Furthermore, radio packages of the present disclosure can have shapes other than that of a regular hexagonal prism. For example, a radio package could have six rectangular sides (e.g., a cubic shape) with one or more antennas located on any two or more of those six sides.

In order to provide multiple functionalities in a semiconductor device package, multiple semiconductor device dies and other functional structures can be incorporated in the package. In order to provide the desired functionalities in a package consuming as little floorplan area as possible, the multiple semiconductor device dies and other structures can be stacked one on top of the other. An example of a method for incorporating multiple semiconductor device dies in a package is fan-out wafer-level packaging (FOWLP), which involves positioning one or more semiconductor device dies on a carrier wafer/panel, molding the device die(s) and other structures, followed by forming a redistribution layer on top of the molded area, and then forming solder balls on an active surface of the device package.

In a preferred technique, radio packages of the present disclosure, such as the radio package 100 of FIG. 1, are fabricated using a suitable additive manufacturing process. Additive manufacturing (also known as 3D printing) builds up features of a part layer-by-layer from a geometry described in a three-dimensional design model. Additive manufacturing techniques can be used to form 3D interconnects, ultra-fine feature circuitry, and component- and die-attach structures, as well as perform component underfill and encapsulation. By using conductive inks in combination with base materials (e.g., dielectrics), additive manufacturing can be used to print 3D packages as a single, continuous part, effectively creating fully functional electronics that require little-to-no assembly. Materials that can be used for additive manufacturing can include, for example, thermoplastics, metals, ceramics, graphene, and nanomaterials that include silver or copper.

Embodiments of the present invention incorporate antenna structures into a semiconductor device package using additive manufacturing techniques to place a ground plane for each antenna in a more desirable location for certain applications than can be performed using traditional techniques. Embodiments can also place conductive traces from a semiconductor device die to the ground plane of each antenna in order to minimize a signal distance to the ground plane. In addition, the additive manufacturing techniques can be used to form each antenna itself along with signal traces.

In one implementation, the fabrication process for the integrated radio package 100 of FIG. 1 involves the following steps:

Start building input/output (I/O) layers on a process carrier together with horizontal and vertical interconnection traces (i.e., routing traces) as needed using 3D printing;

Place/attach the IC die 110 and any other components on the I/O layers with the IC die's antenna I/O port face up;

Continue building connection traces and filling materials using 3D printing;

Continue building connection traces connecting the IC die 110 and any other components using 3D printing, including the connection trace to the 3-way power combiner/divider structure 112; and Continue building 3-way power combiner/divider structure 112 using 3D printing with appropriate materials used for different sections for filling, for RF, for resistors, etc., with interconnection feed lines built in the process, where the antennas 108 can be built from bottom to the top in the 3D printing process.

Alternatively, the antennas 108 can be built up one antenna at a time with the corresponding module side surface facing up, with RF material applied between ground planes and radiating elements.

By now it should be appreciated that there has been provided a semiconductor device package comprising at least one IC die; at least two antennas oriented in at least two different directions; and a combiner/divider structure connecting the at least two antennas to the at least one IC die and configured to combine/divide signals transmitted between the at least two antennas and the at least one IC die.

Another embodiment of the present invention provides a method for fabricating the above-referenced semiconductor device package, the method comprising (i) providing the at least one IC die and (ii) forming the at least two antennas and the combiner/divider structure using an additive manufacturing process.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

The term "coupled," as used herein, is not intended to be limited to a direct coupling or a mechanical coupling.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. A semiconductor device package comprising:

at least one IC die;

three antennas oriented 120 degrees apart; and a combiner/divider structure connecting the three antennas to the at least one IC die and configured to combine/divide signals transmitted between the three antennas and the at least one IC die, the combiner/divider structure comprising four ports interconnected by six links at five nodes, wherein:

a first link connects (i) a first node at a first port and (ii) a second node at a second port;

a second link connects (i) the first node at the first port and (ii) a third node at a third port;

a third link connects (i) the first node at the first port and (ii) a fourth node at a fourth port;

a fourth link connects (i) the second node at the second port and (ii) a fifth node;

a fifth link connects (i) the third node at the third port and (ii) the fifth node; and a sixth link connects (i) the fourth node at the fourth port and (ii) the fifth node.

2. The package of claim 1, wherein:

the fourth, fifth, and sixth links each have an impedance of $Z_0$; and the first, second, and third links each have an impedance of SQRT(3) $Z_0$.

3. The package of claim 1, wherein the first, second, and third links each follow a horizontal rectilinear path.

4. The package of claim 1, wherein the first, second, and third links each follow a vertical rectilinear path.

5. The package of claim 1, wherein the combiner/divider structure is a Wilkinson structure.

6. The package of claim 1, wherein the three antennas are oriented normal to a bottom of the package.

7. The package of claim 1, wherein the package comprises six antennas oriented 60 degrees apart.

8. The package of claim 7, wherein the combiner/divider structure comprises two three-way structures connected to one two-way structure.

9. The package of claim 7, wherein the combiner/divider structure comprises three two-way structures connected to one three-way structure.

10. The package of claim 1, wherein the package is manufactured using an additive manufacturing process.

11. The package of claim 1, wherein the package is an integrated radio package having a multi-directional antenna array comprising the three antennas.

12. A method for fabricating a semiconductor device package, the method comprising:

providing at least one IC die;

forming at least two antennas oriented in at least two different directions;

forming a combiner/divider structure using an additive manufacturing process, the combiner/divider structure connecting the at least two antennas to the at least one IC die and configured to combine/divide signals transmitted between the at least two antennas and the at least one IC die;

using 3D printing to build up input/output (I/O) layers having horizontal and vertical interconnection traces on a process carrier;

attaching a first IC die on the I/O layers with an antenna I/O port of the first IC die face up; and using 3D printing to build up the at least two antennas and a combiner/divider structure electrically interconnecting the at least two antennas and the antenna I/O port of the first IC die and contained within potting compound.

13. The method of claim 12, wherein the combiner/divider structure comprises a first link that follows a rectilinear path having straight sub-links that interconnect at right angles, wherein the sub-links of the first link are formed using 3D printing.

14. The method of claim 13, wherein 3D printing is used to form the first link comprising a vertical rectilinear sub-link and three horizontal rectilinear sub-links.

15. The method of claim 13, wherein 3D printing is used to form the first link comprising two vertical rectilinear sub-links and two horizontal rectilinear sub-links.

16. The method of claim 12, wherein 3D printing is used to form the at least two antennas at right angles to the I/O layers.

17. The method of claim 12, further comprising:

using 3D printing to build up a redistribution layer; and forming solder balls on an active surface of the package.

* * * * *